US006530325B2

(12) United States Patent
Shapiro et al.

(10) Patent No.: US 6,530,325 B2
(45) Date of Patent: Mar. 11, 2003

(54) METHOD OF SCRAPPING STEEL STRUCTURES

(75) Inventors: Gregory E. Shapiro, St. Louis, MO (US); Paul Worsey, Rolla, MO (US)

(73) Assignee: Shapiro Brothers, Inc., Festus, MO (US)

( * ) Notice: Subject to any disclaimer, the term of this patent is extended or adjusted under 35 U.S.C. 154(b) by 0 days.

(21) Appl. No.: 09/903,198

(22) Filed: Jul. 11, 2001

(65) Prior Publication Data

US 2003/0010245 A1 Jan. 16, 2003

(51) Int. Cl.[7] ..... F42D 3/00

(52) U.S. Cl. ..... 102/302; 102/301; 102/399; 102/408

(58) Field of Search ..... 102/301, 302, 102/325–327, 399, 408

(56) References Cited

U.S. PATENT DOCUMENTS

| | | | | | |
|---|---|---|---|---|---|
| 16,473 | A | | 1/1857 | Eads | |
| 139,452 | A | | 6/1873 | Burson | |
| 1,961,591 | A | | 6/1934 | McArdle et al. | |
| 4,160,413 | A | * | 7/1979 | Ridgeway | 102/306 |
| 4,174,624 | A | * | 11/1979 | Shrum | 72/56 |
| 4,188,884 | A | * | 2/1980 | White et al. | 102/399 |
| 4,222,329 | A | | 9/1980 | Austin | |
| 4,345,530 | A | * | 8/1982 | Gutschmidt | 110/215 |
| 4,408,535 | A | | 10/1983 | Alford | |
| 4,699,066 | A | | 10/1987 | Eriksson | |
| 4,836,079 | A | * | 6/1989 | Barrett | 102/303 |
| 5,009,374 | A | | 4/1991 | Manfredi et al. | |
| 5,044,252 | A | * | 9/1991 | Gamadi et al. | 109/78 |
| 5,192,819 | A | * | 3/1993 | Baumgartner | 102/313 |
| 5,231,245 | A | * | 7/1993 | Shann | 102/303 |
| 5,551,344 | A | * | 9/1996 | Couet et al. | 102/312 |
| 5,613,453 | A | * | 3/1997 | Donovan | 110/237 |
| 5,728,967 | A | * | 3/1998 | Parkes | 102/303 |
| 5,884,569 | A | * | 3/1999 | Donovan | 110/237 |
| 6,339,992 | B1 | * | 1/2002 | Watson | 102/302 |
| 6,397,753 | B2 | * | 6/2002 | Keenan et al. | 102/301 |
| 6,408,761 | B1 | * | 6/2002 | Arai et al. | 102/202.7 |
| 6,431,073 | B1 | * | 8/2002 | Zilka et al. | 102/302 |

OTHER PUBLICATIONS

Rune Gustafsson, "Blasting with Water Pressure," Blasting Technique, 1981, p. 293, Dynamit Nobel Wien Gesellschaft m.b.H., Vienna.

* cited by examiner

*Primary Examiner*—Peter M. Poon
*Assistant Examiner*—Susan Piascik
(74) *Attorney, Agent, or Firm*—Sonnenschein Nath & Rosenthal

(57) ABSTRACT

A method of breaking up a structure for the recovery of steel as scrap. The structure has steel plates forming a compartment secured to framing in the compartment. The method includes at least partially filling the compartment with a substantially incompressible substance and placing explosive in the substance in the compartment. The explosive is sufficient and adapted on detonation thereof to pressurize the compartment to the extent of causing separation of the plates from the framing. The method further includes detonating the explosive.

20 Claims, 6 Drawing Sheets

25
57
57
57
57
57
57
57
57
57
57
57
57
57
57
57
57

METHOD OF SCRAPPING STEEL STRUCTURES

BACKGROUND OF THE INVENTION

This invention relates broadly to scrapping structures having steel components for recovery of the steel as scrap; and more particularly, to a method of scrapping barges having extensive steel plate incorporated therein, for the recovery of the steel as scrap for recycling.

The invention is primarily concerned with scrapping barges which have outlived their usefulness on the rivers and/or seas. Such barges typically include large quantities of steel which, when salvaged as scrap, represent a valuable commodity. While the invention is herein disclosed as it pertains to the scrapping of barges, it is contemplated that it may be applicable to the scrapping of other structures having floodable compartments and steel plate worthy of salvaging for recycling.

Typically, barges such as those to be scrapped in accordance with the invention have a bottom, sides extending up from the bottom and ends extending between the sides defining a cargo hold. The sides and ends comprise steel plates welded together on framing. Heretofore, such barges have been scrapped after they have outlived their usefulness on the waterways (i.e., after becoming unserviceable) primarily by cutting off steel plates with a cutting torch and breaking up the cut-off plates into scrap (i.e., small pieces) by means of hydraulic shears. This procedure, although effective, is labor intensive, typically taking as much as several man weeks to complete and thereby increasing the cost of the scrap and reducing profitability.

SUMMARY OF THE INVENTION

Accordingly, among the several objects of this invention may be noted the provision of a method of scrapping a steel structure such as a barge by breaking up the structure for the recovery of steel as scrap which reduces the labor involved in scrapping the structure over that heretofore required, thereby making scrapping more economical; the provision of such a method adapted concurrently to effect reduction of the steel to scrap pieces as well as the break-up; and the provision of such a method using relatively economical components.

It is contemplated that the method would be applicable to the scrapping of structures other than steel barges which have steel plates forming a floodable compartment secured to framing in the compartment. The method involves breaking up the structure for the recovery of steel as scrap by at least partially filling the compartment with a substantially incompressible substance and placing explosive in the substance in the compartment. The explosive is sufficient and adapted on detonation thereof to pressurize the compartment to the extent of causing separation of the plates from the framing. The method further includes detonating the explosive.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
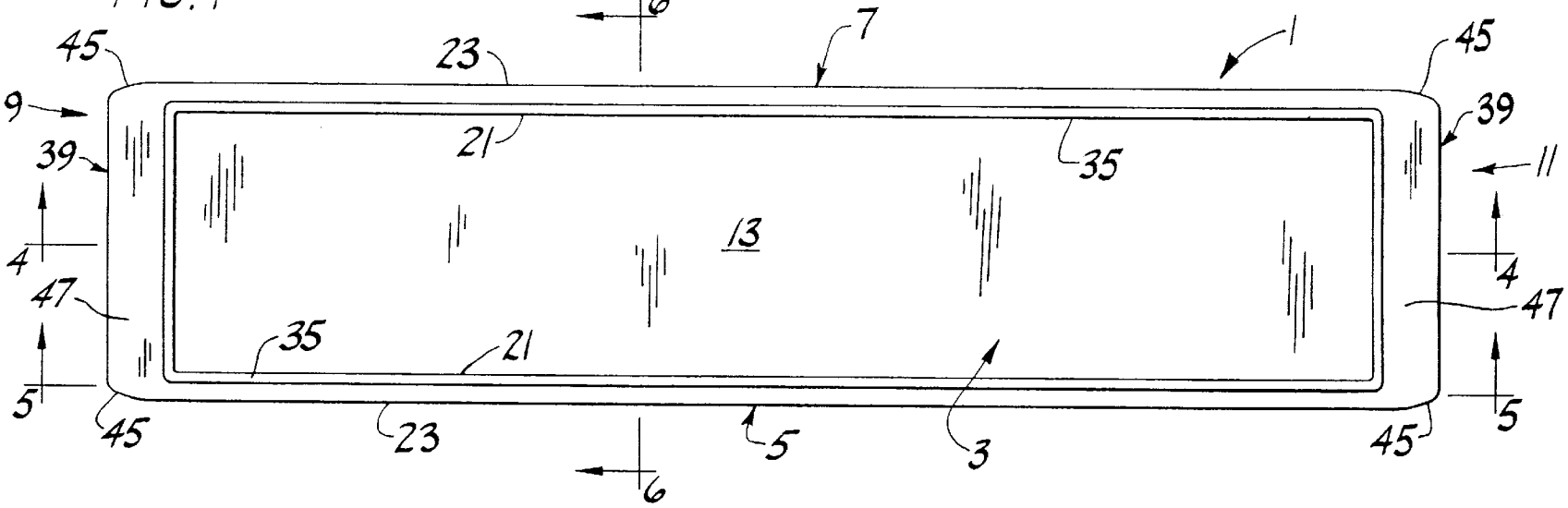
FIG. 1 is a plan of a barge of a type subject to scrapping for steel using the method of the present invention.
Figure 2:
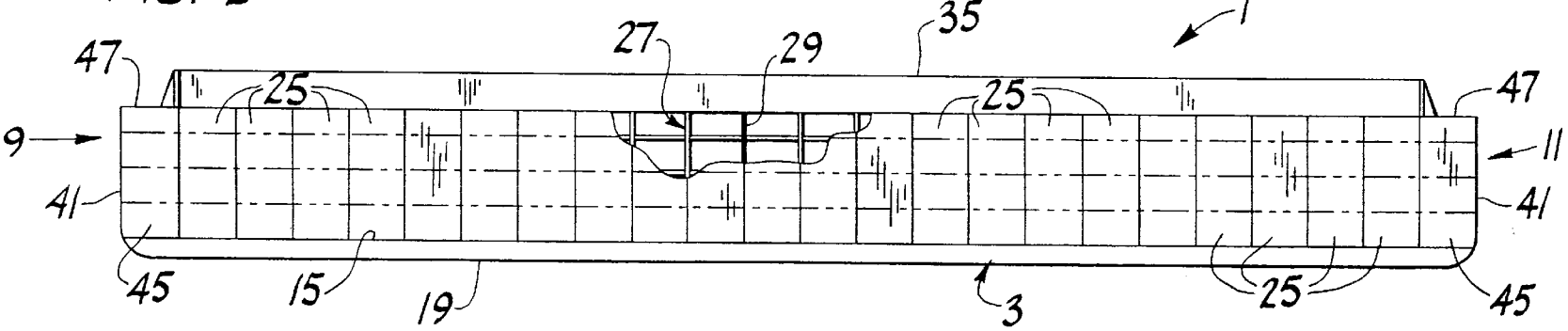
FIG. 2 is a side elevation of the barge partially broken away.
Figure 3:
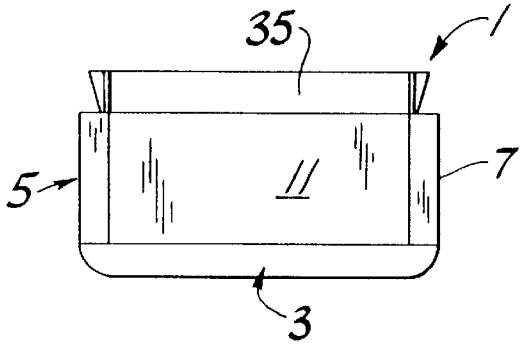
FIG. 3 is an end elevation of the barge.
Figure 4:
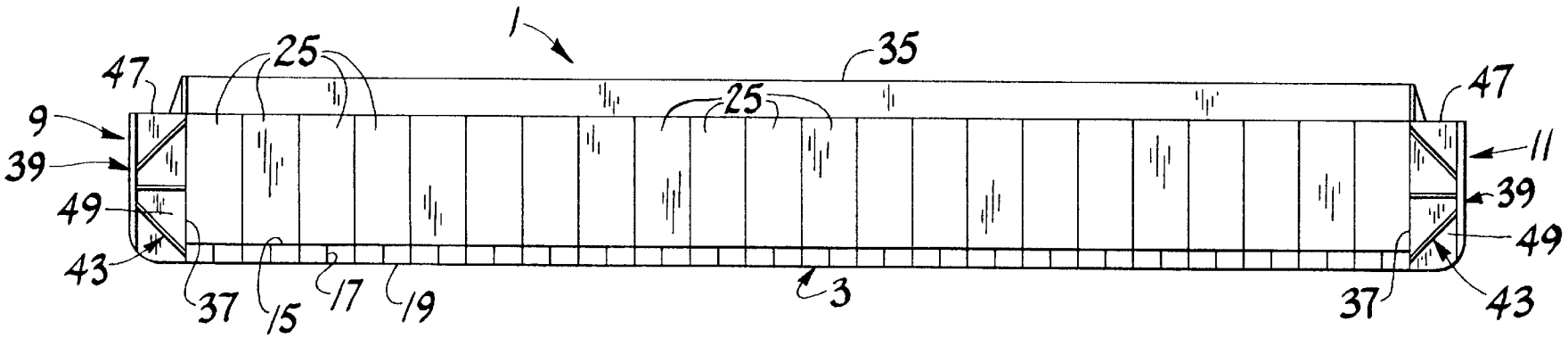
FIG. 4 is a section through the barge taken in the plane of line 4—4 of FIG. 1.
Figure 5:
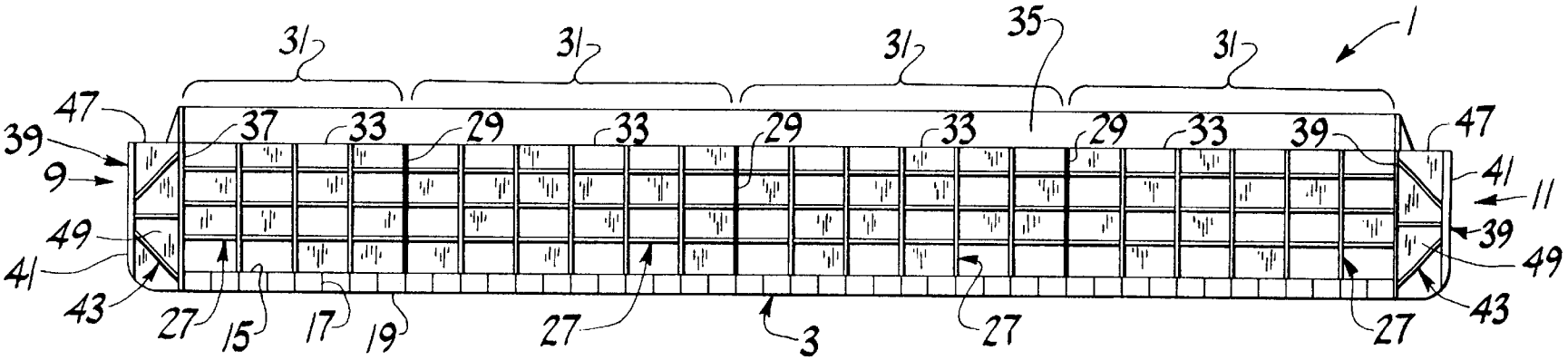
FIG. 5 is a section taken in the plane of line 5—5 of FIG. 1.
Figure 6:
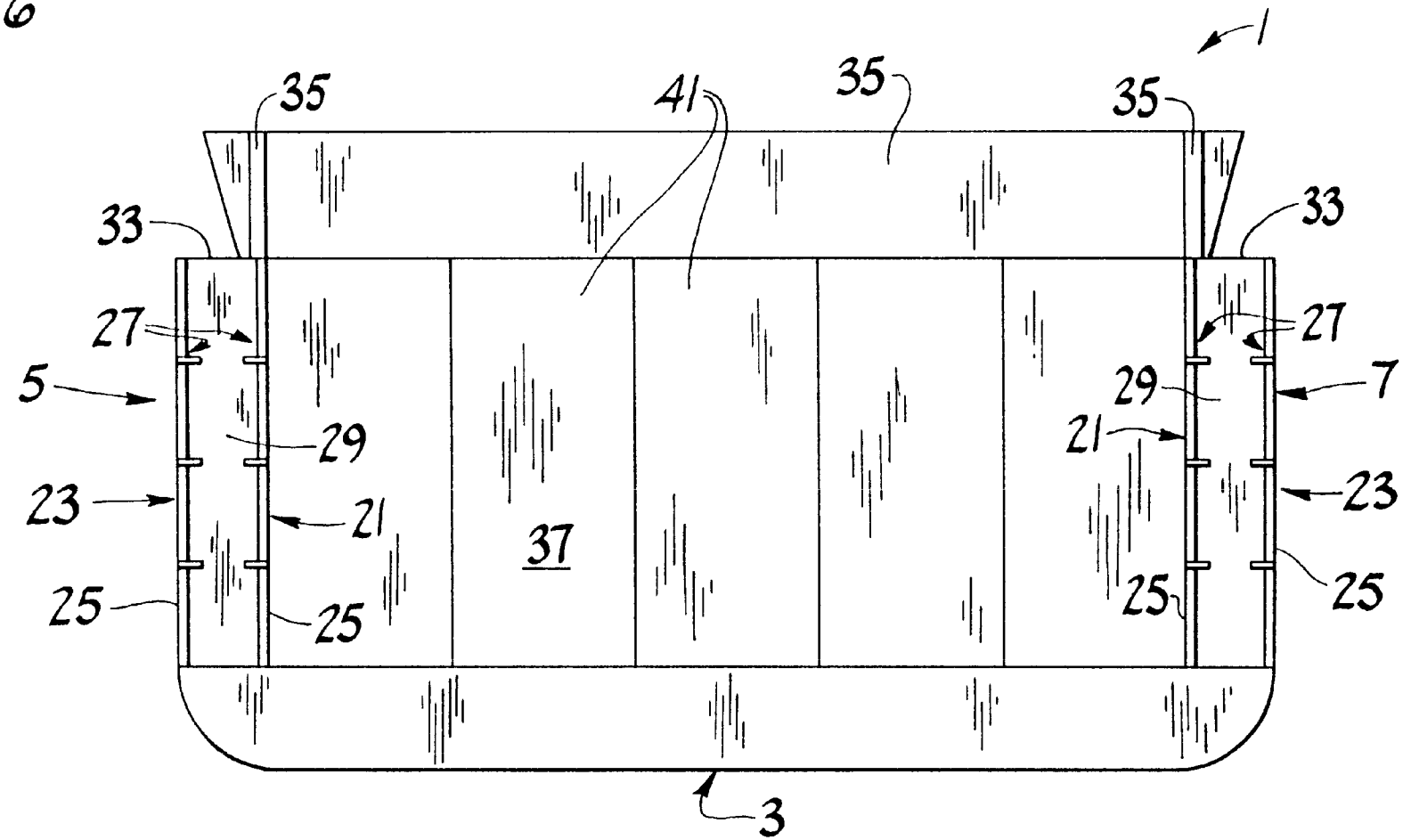
FIG. 6 is a section taken in the plane of line 6—6 of FIG. 1.

Referring to the drawings and first to FIGS. 1–6, a conventional barge made principally of steel to be scrapped in accordance with the present invention is designated in its entirety by the reference numeral 1. The barge 1 is essentially rectangular in plan comprising an essentially rectangular bottom 3. Sides 5, 7 and ends 9, 11 extend upward from the bottom 3 to define an essentially rectangular cargo hold 13. Either end 9, 11 may be the forward end and the other the aft end. The barge may, for example, be on the order of about two hundred feet long (in overall length) and about thirty-five feet wide, thereby incorporating a substantial amount of steel subject to salvage as scrap.

The bottom 3 is typically of double construction comprising a steel cargo hold floor 15 mounted on transverse steel stringers 17 on a flat steel outer hull 19. The floor 15 and hull 19 comprise steel plates having their edges welded to adjoining plates and to the stringers 17. The sides 5, 7 are essentially identical to each other. Each of the sides 5, 7 is of double-walled construction comprising two spaced walls, an inner wall designated in its entirety by the reference numeral 21 and an outer wall designated in its entirety by the reference numeral 23. The walls 21, 23 extend upward generally vertically from the periphery of the bottom 3. Each of the walls 21, 23 comprises a plurality of steel plates 25 secured by welding to adjoining plates and to internal steel framing indicated generally at 27 including partitions or bulkheads 29 also of steel plate dividing the space between the walls into compartments 31. Each side 5, 7 has a top 33 comprising steel plates surmounted by a steel coaming 35 which surrounds a top of the cargo hold 13. The barge ends 9, 11 are substantially identical to each other. In an alternate embodiment (not shown), the barge ends may differ from each other. Each of the ends 9, 11 is of double-walled construction comprising two spaced walls, an inner wall designated in its entirety by the reference numeral 37 and an outer wall designated in its entirety by the reference numeral 39. These end walls 37, 39 extend up from the periphery of the bottom 3. Each of the end walls 37, 39 comprises a plurality of steel plates 41 secured by welding to adjoining plates and to internal framing indicated generally at 43. Each of the ends 9, 11 has steel plate sides 45 and a top 47 which with the bottom 3 and walls 37, 39 form a floodable compartment 49.

Figure 7:
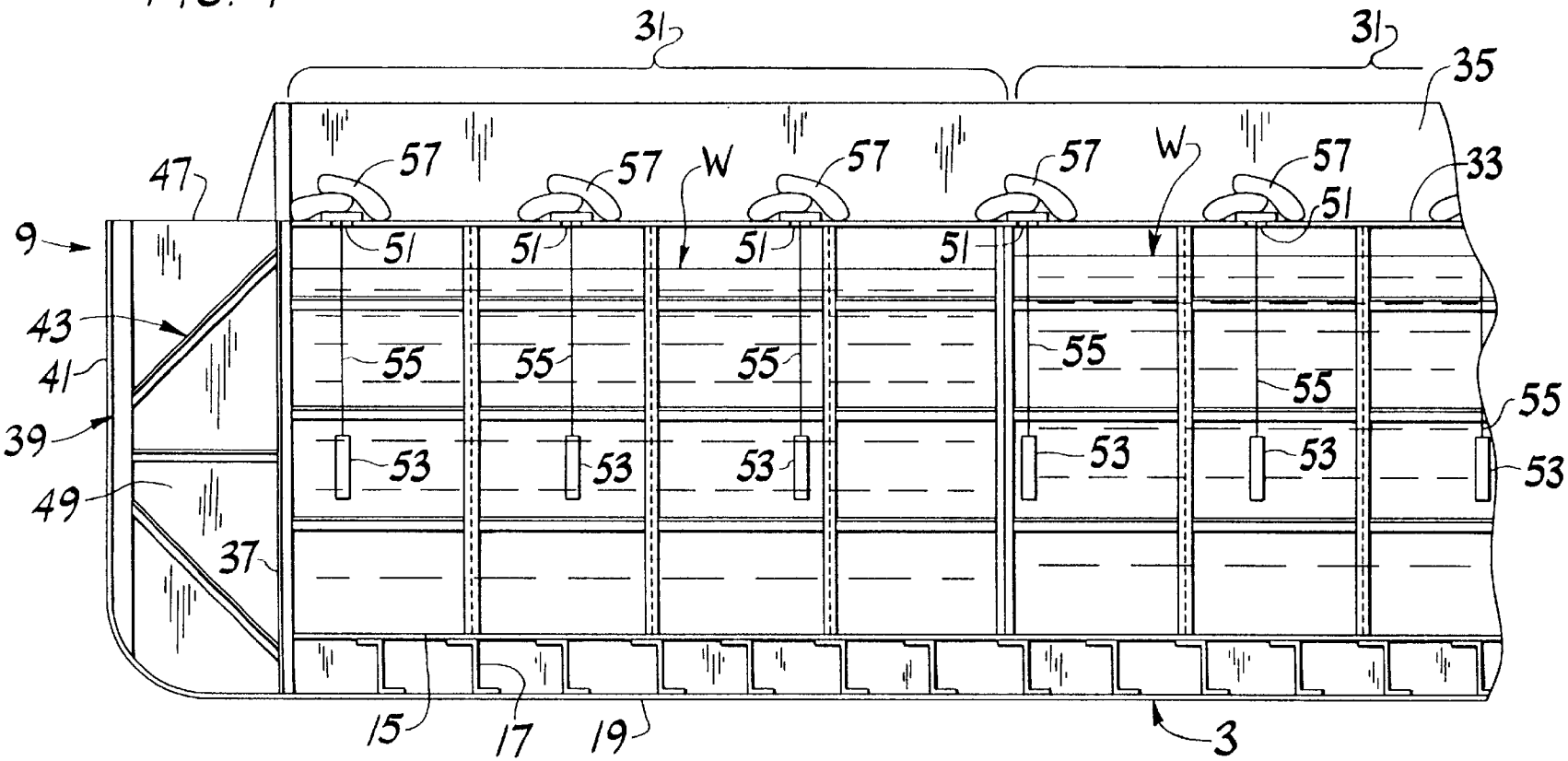
FIG. 7 is a detail of the section of FIG. 5.

To scrap a barge such as described above, the barge is hauled out of the water, and then broken up by the method of this invention for the recovery of its steel as scrap. As illustrated in FIG. 7, holes such as indicated at 51 are cut in the top 33 of each side 5, 7 of the barge providing access to each of the compartments 31 and in the top 47 of each end 9, 11 of the barge providing access to each of the compartments 49. Each compartment 31, 49 is at least partially filled with a substantially incompressible substance such as water W through one or more of the holes 51. The compartments may be filled with other incompressible substances such as sand or mud instead of or in addition to the water. Conventional explosive charges 53 are placed in the water W in each compartment 31, 49. Each charge 53 has a conventional detonator (not illustrated) for detonating the explosive. As shown in FIG. 7, in one embodiment the charges 53 are suspended in the water W in the compartments 31, 49 through the holes 51 by rope, cables, wood or polymeric pipe 55. Conventional non-electric detonators (not shown) are connected to the charges 53 prior to being lowered into the compartments 31, 49. Although the charges 53 may be suspended at other heights within the compartments 31, 49 without departing from the scope of the present invention, in one embodiment the charges are suspended about halfway between the top and bottom of the compartments. After the charges 53 are inserted through the holes 51 and suspended in the compartments 31, 49, the holes 51 are covered such as with sandbags 57. The charges 53 in each compartment 31, 49 are capable of such explosive force on detonation thereof as to pressurize the water in the compartment to the extent of causing separation of the plates 25, 41 from the internal framing 27, 43. More preferably, the charges 53 are capable of causing the separation of the plates 25, 41 at the welds which secured them to the internal framing 27, 43 and to each other.

After the explosive charges 53 are placed in the water W in the compartments 31 and the holes 51 are covered, the charges are detonated, causing pressurization of the water in the compartments 31, 49 with resultant separation of plates 25, 41 from the internal framing 27, 43 (including the bulkheads 29) and separation from one another, separation occurring primarily at the welds which secured the plates to the internal framing and which secured them together. The separated plates may then be folded or cut up into scrap by hydraulic shears.

The explosive charges 53 may be all detonated simultaneously or may be detonated at intervals such as one-quarter second intervals one after another. Although the holes 51 (and therefore the charges 53) may be spaced at other intervals without departing from the scope of the present invention, in one embodiment the holes are spaced at three to five foot intervals along the sides 5, 7 and ends 9, 11 of the barge 1. The holes 51 may be on the order of three inches in diameter. Although other amounts and kinds of explosive may be used, in one embodiment each explosive charge 53 is a charge of dynamite in an amount between about 0.05 pound per ton of water W in the respective compartment 31, 49 to about 0.8 pound per ton of water in the respective compartment. Preferably, the explosive charge 53 is a non-dead-pressing explosive. Further, it is desirable that the charge 53 have a negative buoyancy.

As will be appreciated by those skilled in the art, the amount of explosive needed is inversely proportionate to the depth of the water W in the compartment 31, 49. Because some compartments leak, they cannot be easily filled entirely with water W. More explosive is needed in the compartments which cannot be filled with water. For example, if the compartments 31, 49 are filled ten feet deep with water, it may only be necessary to use eight pounds of dynamite spaced at five foot intervals around the barge 1. However, if the compartments 31, 49 can only be filled five feet deep with water, it is envisioned a greater amount of dynamite (e.g., 11 pounds spaced at five foot intervals) may be needed.

Figure 8:
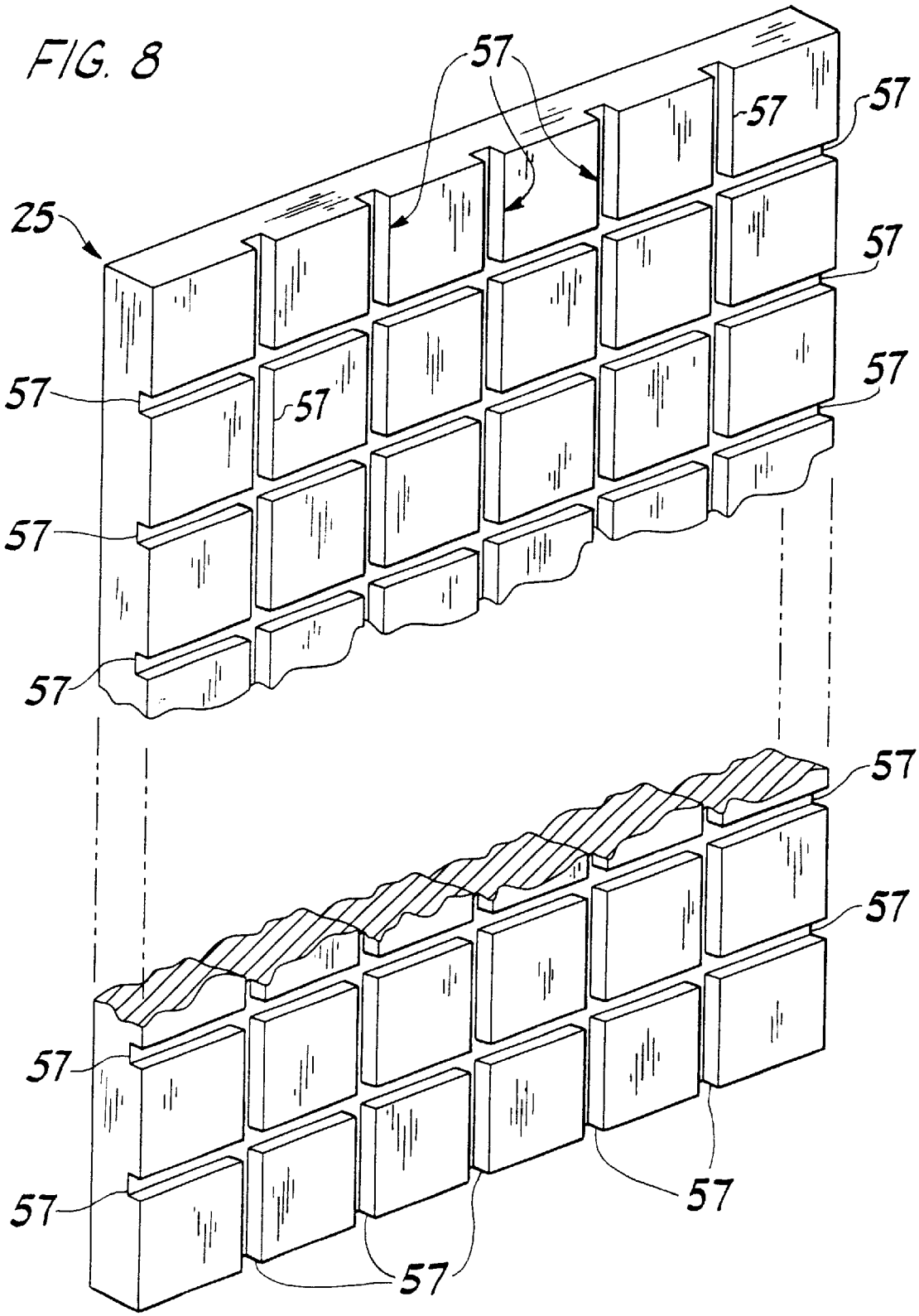
FIG. 8 is a perspective of a plate weakened for scrapping in accordance with the present invention.

In certain instances, the need for cutting up the broken-off plates 25, 41 with hydraulic shears may be eliminated by weakening the plates 25, 41 beforehand so that they will be broken up into pieces on detonation of the explosive. This weakening may, for example, be by scoring the plates 25 on the barge in a grid pattern such as shown in FIG. 8, the scores being indicated at 57. Scoring may be carried out by using a grinder, for example. Alternatively, it is envisioned that the weakening may be accomplished by strategically cutting or notching or embrittling the plates 25, 41 and framing 27, 43 in an appropriate pattern. It is envisioned that a conventional torch may be used to create a heat affected zone to embrittle the plates thereby to weaken them.

It is noteworthy that, even though the blasting may be carried out in a populated area, the sound of the blasting is deadened, being muffled by the water W. Also, the plates come loose, and/or break up into pieces, without any particular danger from steel flying around.

Using the method of the present invention, the preparation for blasting, the blasting and subsequent work requires much fewer man-hours than previous methods.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

What is claimed is:

1. In scrapping for its steel a structure having steel plates forming a compartment secured to framing in the compartment, the method of breaking up the structure for the recovery of steel as scrap, comprising:

at least partially filling the compartment with a substantially incompressible substance;

placing explosive in the substance in the compartment, the explosive being sufficient and adapted on detonation thereof to pressurize the compartment to the extent of causing separation of the plates from the framing;

detonating the explosive to separate the plates from the framing; and recovering the plates.

2. The method of claim 1 wherein the plates are weakened beforehand to be broken up into pieces on detonation of the explosive.

3. The method of claim 1 wherein the explosive is suspended in the substance in the compartment.

4. The method of claim 1 wherein the plates are weakened beforehand to be broken up into pieces on detonation of the explosive and the explosive is suspended in the substance in the compartment.

5. The method of claim 1 wherein the plates are secured by welds to the internal framing and are separated from the framing at the welds by the detonation.

6. The method of claim 5 wherein the plates are weakened beforehand to be broken up into pieces on detonation of the charge.

7. The method of claim 5 wherein the charges are suspended in the substance in the compartments.

8. The method of claim 5 wherein the plates are weakened beforehand to be broken up into pieces on detonation of the charge and the charges are suspended in the substance in the compartments.

9. The method of claim 1 wherein the structure is a barge having a bottom, sides each comprising said two spaced walls extending up from the bottom, each side having a top, said partitions in each wall comprising steel plate bulkheads forming with said walls a plurality of compartments.

10. The method of claim 9 wherein the compartments are at least partially filled with substance through holes made in the top of the respective side, the charges are suspended in the substance, and the holes are closed for the detonation.

11. The method of claim 10 wherein the plates are weakened beforehand to be broken up into pieces on detonation of the charge.

12. The method of claim 11 wherein the plates are weakened by scoring.

13. The method of claim 1 wherein the structure is a barge having a bottom, ends each comprising two spaced walls extending up from the bottom, each end having a top, the bottom, walls and top forming said compartment.

14. The method of claim 13 wherein the compartments are at least partially filled with substance through holes made in the top of the respective side, the charges are suspended in the substance, and the holes are closed for the detonation.

15. The method of claim 14 wherein the plates are weakened beforehand to be broken up into pieces on detonation of the charge.

16. The method of claim 15 wherein the plates are weakened by scoring.

17. In scrapping for its steel a structure having two spaced walls each comprising steel plates secured to internal framing with partitions dividing the space between the walls into compartments, the method of breaking up the structure for the recovery of steel as scrap comprising:

at least partially filling the compartments with a substantially incompressible substance;

placing explosive charges in the substance in the compartments;

the charges being adapted on detonation to pressurize the compartments to the extent of causing separation of the plates from the framing;

detonating the charges to separate the plates from the framing; and recovering the plates.

18. The method of claim 17 wherein the explosive charges are detonated at intervals one after another.

19. The method of claim 17 wherein the plates are weakened beforehand to be broken up into pieces on detonation of the charges.

20. The method of claim 17 wherein the plates are weakened beforehand to be broken up into pieces on detonation of the charges by scoring.

* * * * *